United States Patent [19]

Ruiz

[11] Patent Number: 4,714,173

[45] Date of Patent: Dec. 22, 1987

[54] LEAK-PROOF CLOSURES

[76] Inventor: Guillermo E. Ruiz, 800 W. 35 St., Hialeah, Fla. 33012

[21] Appl. No.: 861,893

[22] Filed: May 12, 1986

[51] Int. Cl.[4] ..... A47G 21/18

[52] U.S. Cl. ..... 220/90.4; 229/7 S

[58] Field of Search ..... 220/90.4, 367, 369, 220/373; 229/7 S, 1.5 B; 215/1 A, 11 B, 11 D

[56] References Cited

U.S. PATENT DOCUMENTS

| | | | |
|---|---|---|---|
| 2,948,453 | 8/1960 | Drown | 220/90.4 X |
| 3,200,980 | 8/1965 | Jamell | 215/11 B |
| 3,335,897 | 8/1967 | Castro | 220/373 |
| 4,247,016 | 1/1981 | Shaw | 229/7 S X |
| 4,494,668 | 1/1985 | Lottick | 220/90.4 |
| 4,607,755 | 8/1986 | Andreozzi | 220/90.4 X |

*Primary Examiner*—Steven M. Pollard

*Attorney, Agent, or Firm*—Jesus Sanchelima

[57] ABSTRACT

A cover for openings in containers such as plastic or paper cups used, primarily, in fast food restaurants. The cover may include at least one one-way valve mechanism or be made of a porous material that allows air through but not liquids. An orifice with a tubular extension attached thereto provides a suitable engagement with a straw that is used to withdraw the liquid contained on the cup. Anchorage members are provided on the upper surface of the cover so that the straw may be bent when not in use.

7 Claims, 7 Drawing Figures

LEAK-PROOF CLOSURES

BACKGROUND OF THE INVENTION

1. Field of the Invention

The present invention relates to closures or covers for recipients, cups, vessels or the like that are leak-proof when filled with a liquid and closed.

2. Description of the Related Art

In fast food establishments, it is common to receive liquids in "to go" containers which are usually plastic or paper cups with a plastic cover that snaps around the rim of the cup. The cover is provided with an orifice through which a conventional straw is inserted. The orifice has to be somewhat larger than the diameter of the straw so that air can penetrate inside the cup to fill the space left by the displaced liquid as it is suctioned by the user. The opening between the outer surface of the straw and the periphery of the orifice constitutes the main source of leakage when the container is tipped over. Also, leakage occurs through the straw itself and through the peripheral engagement of the cover and the container's rim. Here, as it will be disclosed below, the invention provides a leak-proof cover that permits the user to carelessly manipulate the container without spilling its liquid.

SUMMARY OF THE INVENTION

It is the main object of the present invention to provide a closure that when used in conjunction with a plastic cup or similar container it makes it leak-proof.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
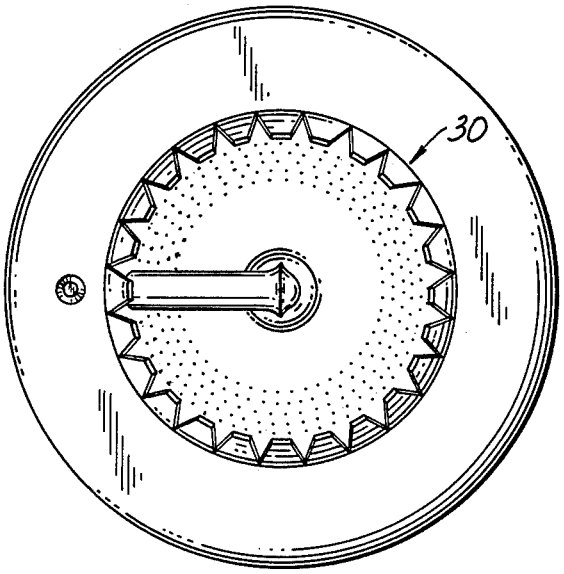
FIG. 2 illustrates a top view of the improved closure represented in FIG. 1.
Figure 1A:
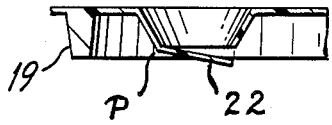
FIG. 1A shows a detailed view of the valve mechanism.
Figure 1:
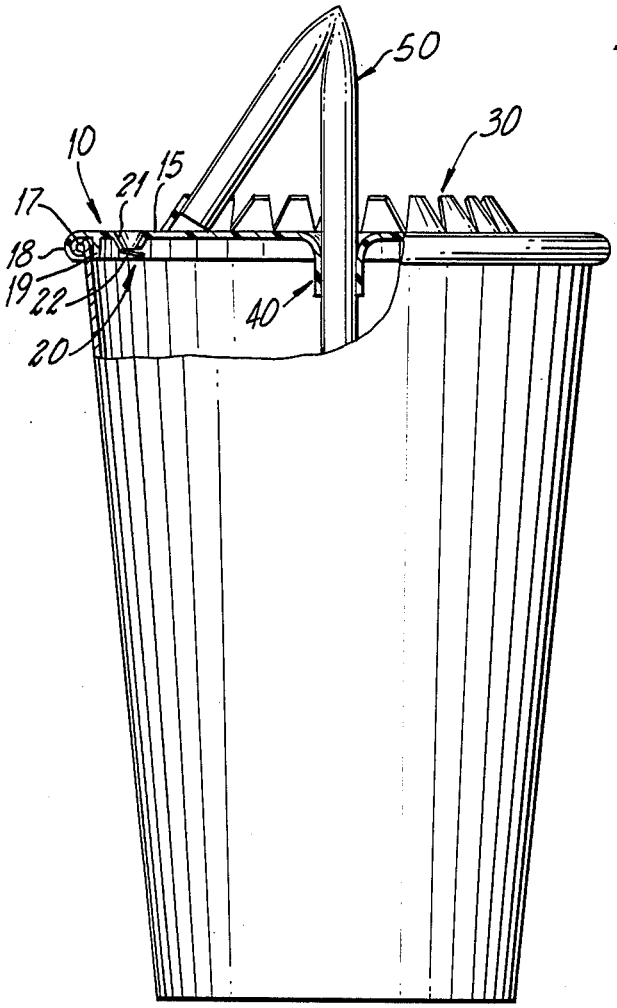
FIG. 1 represents a partial cross-section of the side of a container with the preferred embodiment of the improved closure showing a bent straw.
Figure 3:
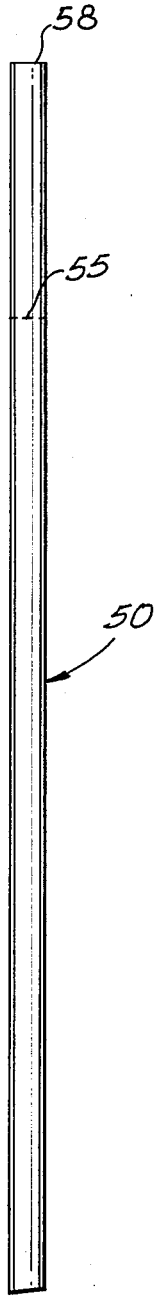
FIG. 3 is a side view of the straw to be used with the closure illustrated in FIGS. 1 and 2.
Figure 5:
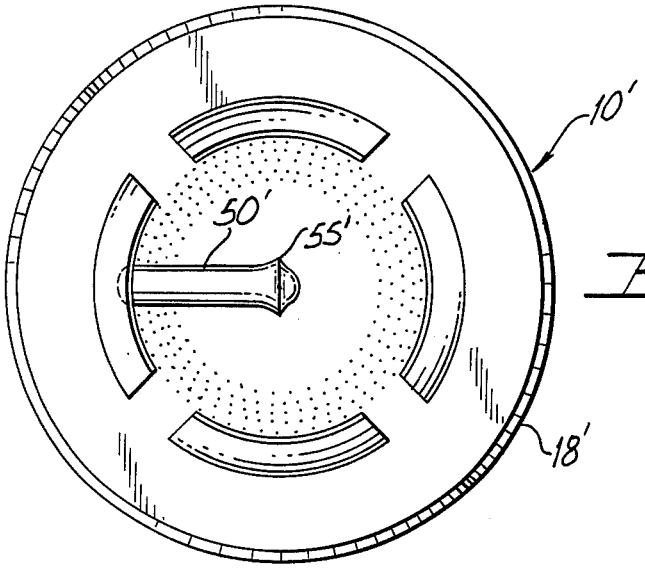
FIG. 5 illustrates a top view of the alternate closure of FIG. 4.

Referring now to FIG. 1, where the present invention is generally referred to with numeral 10, it can be observed that it has substantially the shape of conventional closures or covers for plastic or paper cups or any similar container of any other material as usually employed in fast food restaurants with the exception of valve mechanism 20, anchorage members 30 and tubular orifice extension 40. Cover 10 tightly engages around its periphery with the rim of cup or container being closed.

Figure 4:
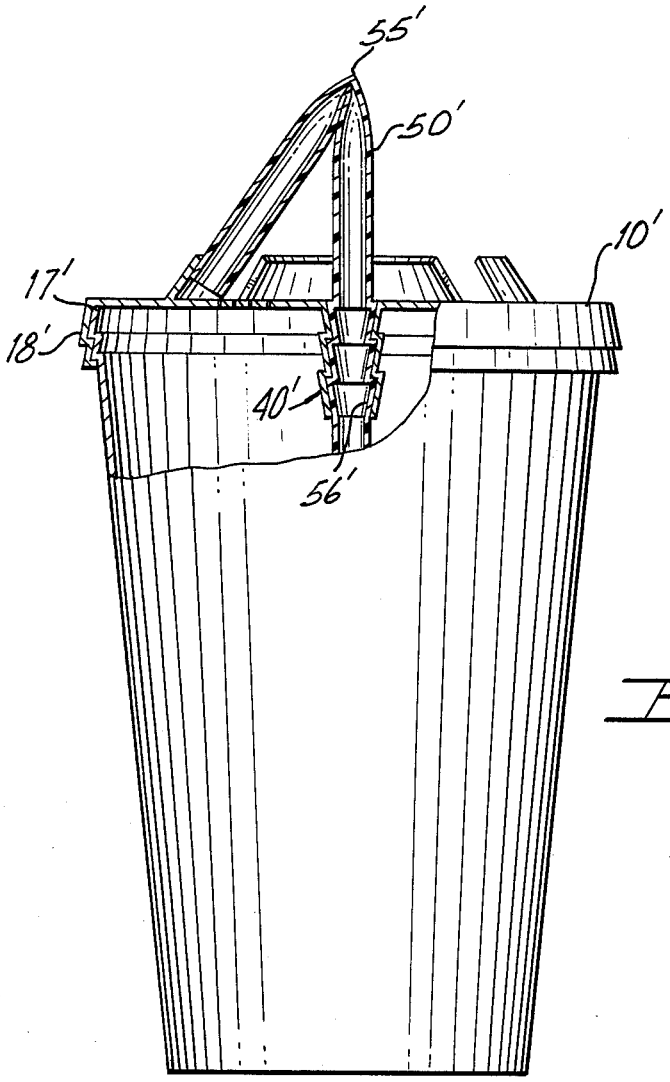
FIG. 4 represents a partial cross-section of the side of a container with a porous cover and accordion sections for the tubular extension and the straw.

Valve mechanism 20 is a simple one-way type valve that allows the outside air to penetrate inside the container to fill the space previously occupied by the liquid being suctioned by the user. In the preferred embodiment, one of such valve mechanism 20 is illustrated but more than one may also be used. However, one is sufficient and minimizes sources of leakage. Valve mechanism 20 is formed by punching through the bottom 22 of depression 21. Bottom 22 is allowed to pivotally move around point P, as shown in FIG. 1A. A first alternate embodiment utilizes a material for surface 15 of a porosity of less than 1/20 of a millimeter. With these pores, air is allowed in to take the place of the liquid sucked by the user but the liquid is not allowed to go through. In FIG. 4, cover 10 is illustrated, without a valve mechanism 20, and being made of a porous material with the above mentioned characteristics. It is possible, however, to combine both forms of allowing the air in while preventing the liquid from coming out.

Anchorage members 30 provide a support or detent for straw 50 when it is bent along line 55 which is at a predetermined distance to provide sufficient length to be accommodated as shown in FIG. 1 when the user wants to prevent any leaks through straw 50. Anchorage members 30 are, in the preferred embodiment, integrally built on the upper surface 15 of cover 10 and they are arranged in a circular formation equidistant from the central axis of orifice tubular extension 40. Anchorage members 30 are mounted diagonally with respect to the plane of upper surface 15 and they all point inwardly thereby providing a locking detent to the end 58 of straw 50 which is inherently resilient and tries to recuperate its original straight alignment.

Figure 6:
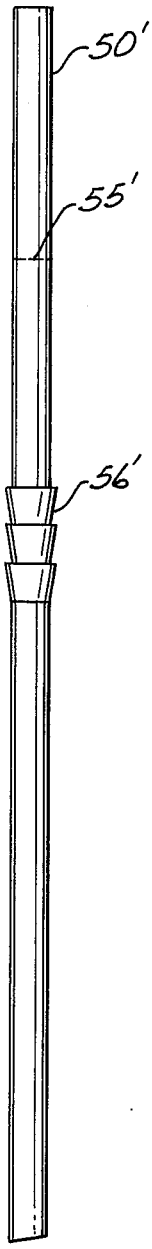
FIG. 6 is a side view of the straw used in FIG. 4.

Orifice tubular extension 40 provides a liquid tight engagement with straw 50 of a given diameter. The viscosity of the liquid determines how tight this engagement needs to prevent leakage. In FIGS. 4 and 6, a modified straw is used in the second alternate embodiment which has an accordion section that mates with a cooperating accordion shaped extension.

Preferably, the peripheral underside of cover 10 includes outer flange 18 that extends downwardly and inwardly. Wall 19 also extends downwardly and is located at a predetermined distance inwardly from flange 18. Flange 18 and wall 19 cooperate to provide a water tight engagement around the periphery of the closure and container interface. Flange 18 includes a slight spring action that allows a ready snap action over rim 17.

The alternate embodiment shown in FIGS. 4; 5 and 6 discloses an orifice accordion extension 40' with a cooperating accordion section 56' on straw 50'. This insures a water tight engagement between straw 50' and closure 10'. Outer flange 18' also has a similar accordion shape to insure that there is no leakage around the rim 17'. This accordion approach is representative of an equivalent variation of orifice extensions and peripheral flanges, but others may also be suitable.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A closure for openings in containers for liquids that are withdrawn with a straw, comprising:

A. cover means tightly engaged to the rims of said openings including an orifice connecting the inside of said container to the outside and further including a tubular extension member mounted to the periphery of said orifice and having a diameter that allows a leak-proof fit of said straw;

B. one-way valve means mounted to said cover means so arranged and constructed that air is allowed in from the outside and said liquid is not allowed to come out regardless of the position of said container; and C. anchorage means for holding the end of said straw bent.

2. The closure set forth in claim 1 wherein said one-way valve means includes a depression in said cover means having a bottom portion pivotally attached.

3. The closure set forth in claim 2 wherein said tubular extension member includes an accordion section and said straw includes a mating accordion section thereby forming a leak-proof engagement.

4. The closure set forth in claim 3 further comprising:

C. at least one one-way valve means mounted to said cover means so arranged and constructed that air is allowed in from the outside when said liquid is withdrawn by said straw and said liquid is not allowed to come out regardless of the position of said container.

5. The closure set forth in claim 3 wherein said tubular member includes an accordion section and said straw includes a mating accordion section thereby forming a leak-proof engagement.

6. The closure set forth in claim 5 wherein said cover means is made out of a porous material that allows air through but not liquids.

7. The closure set forth in claim 6 where said material has a plurality of porous of less than 1/20 of one millimeter in diameter.

* * * * *